US008870532B2

(12) United States Patent
Neeli et al.

(10) Patent No.: US 8,870,532 B2
(45) Date of Patent: Oct. 28, 2014

(54) EXHAUST HOOD DIFFUSER

(75) Inventors: Sudhakar Neeli, Bangalore (IN); Joshy John, Bangalore (IN)

(73) Assignee: General Electric Company, Schenectady, NY (US)

( * ) Notice: Subject to any disclaimer, the term of this patent is extended or adjusted under 35 U.S.C. 154(b) by 625 days.

(21) Appl. No.: 12/945,917

(22) Filed: Nov. 15, 2010

(65) Prior Publication Data

US 2012/0121404 A1 May 17, 2012

(51) Int. Cl.
*F01D 25/24* (2006.01)
*F01D 25/30* (2006.01)

(52) U.S. Cl.
CPC ..... *F01D 25/30* (2013.01); *F05D 2250/11* (2013.01); *F05D 2220/31* (2013.01)
USPC ..... 415/207

(58) Field of Classification Search
USPC ..... 415/226, 224.5, 207
See application file for complete search history.

(56) References Cited

U.S. PATENT DOCUMENTS 5,257,906 A * 11/1993 Gray et al. ..... 415/226
5,301,500 A * 4/1994 Hines ..... 60/792

OTHER PUBLICATIONS

U.S. Appl. No. 12/648,721, Dec. 29, 2009, Dalsania, et al.

* cited by examiner

*Primary Examiner* — Edward Look
*Assistant Examiner* — Jeffrey A Brownson
(74) *Attorney, Agent, or Firm* — Sutherland Asbill & Brennan LLP

(57) ABSTRACT

The present application provides a diffuser for an exhaust hood of a steam turbine. The diffuser may include a first end adjacent to a last bucket and a second end downstream of a steam guide and adjacent to a bearing cone. An exhaust flow path extends therethrough. The second end may include an axial extension enlarging the exhaust flow path.

19 Claims, 4 Drawing Sheets

EXHAUST HOOD DIFFUSER

TECHNICAL FIELD

The present application relates generally to steam turbines and more particularly relates to a diffuser for an exhaust hood with an increased available area ratio therein for an increased pressure recovery within the steam turbine.

BACKGROUND OF THE INVENTION

In the discharge of exhaust steam from an axial flow steam turbine to, for example, an adjacent condenser, the flow of steam therethrough preferably should be relatively smooth. The discharge of the exhaust steam also should minimize energy losses therein from the accumulation of vortices, turbulences, non-uniformities in the flow, and the like.

The exhaust steam from the turbine generally is directed into an exhaust hood. The exhaust steam then passes through an exhaust hood discharge in a direction essentially normal to the axis of the turbine into the condenser or elsewhere. Efficient operation of the steam turbine thus requires a smooth transition from the axial flow through the turbine to the radial flow in the exhaust hood as well as a smooth flow out of the exhaust hood discharge and into the condenser. Achieving a relatively uniform flow distribution at the discharge of the exhaust hood generally provides for an efficient conversion of energy in the turbine and effectively supplies the exhaust steam to the condenser.

Improved efficiency at the later stage buckets of the steam turbine prior to the exhaust generally also requires a relatively uniform circumferential and favorable radial pressure distribution. Diffusers commonly are employed in steam turbines to improve the overall efficiency and output by providing a pressure recovery therein. In conventional exhaust hoods, the maximum pressure recovery generally comes within the diffuser at the end of a steam guide. An amount of the pressure recovery at the end of the steam guide, however, may be lost due to improper area scheduling downstream thereof. Moreover, space limitations may limit the ability of the diffuser to raise the static pressure as the steam velocity is reduced by increasing the flow area. Specifically, attempts have been made to accomplish these efficiency goals while employing an exhaust hood having as short an axial length as possible so as to limit the length of the rotor. Although a reduced rotor shaft length may reduce production costs such also may result in a reduced available area ratio at the end of a steam guide. The loss of an amount of the pressure recovery thus means a loss of low pressure section performance and hence overall efficiency.

There is thus a desire for an improved diffuser for an exhaust hood of a steam turbine. The diffuser preferably provides increased performance and efficiency via an increased available area ratio while also reducing production costs with respect to the length of the rotor and otherwise.

SUMMARY OF THE INVENTION

The present application thus provides a diffuser for an exhaust hood of a steam turbine. The diffuser may include a first end adjacent to a last bucket and a second end downstream of a steam guide and adjacent to a bearing cone. An exhaust flow path extends therethrough. The second end may include an axial extension enlarging the exhaust flow path.

The present application further provides a steam turbine. The steam turbine may include a number of buckets positioned about a rotor, a diffuser extending from a first end adjacent to a last bucket of the number of buckets to a second end downstream of a steam guide and adjacent to a bearing cone. An exhaust flow path extends through the diffuser. The second end of the diffuser may include an axial extension enlarging the exhaust flow path.

The present application further provides a steam turbine. The steam turbine may include a steam guide and a bearing cone therein. The steam guide and the bearing cone may define a diffuser therebetween. An exhaust flow path extends through the diffuser. The bearing cone may define an axial extension therein enlarging the diffuser.

These and other features and improvements of the present application will become apparent to one of ordinary skill in the art upon review of the following detailed description when taken in conjunction with the several drawings and the appended claims.

DETAILED DESCRIPTION

Figure 1:
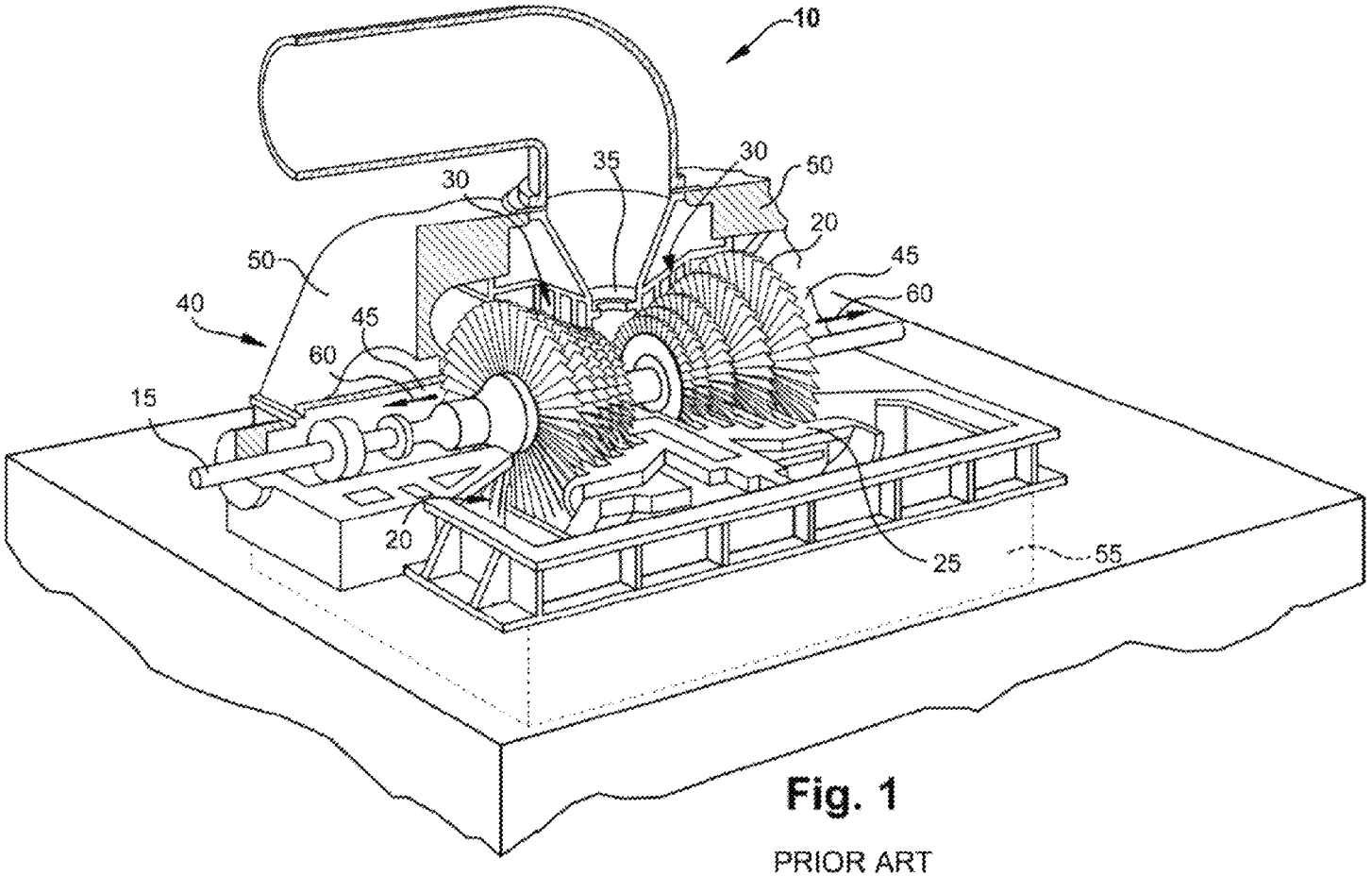
Fig. 1 PRIOR ART
FIG. 1 is a perspective partial cutaway view of a known steam turbine with an exhaust hood.

Referring now to the drawings in which like numerals refer to like elements throughout the several views, FIG. 1 shows a perspective partial cutaway view of a steam turbine 10. Generally described, the steam turbine 10 includes a rotor 15 with a number of turbine buckets 20. The steam turbine 10 also includes an inner turbine casing 25 with a number of stator vanes 30 extending therefrom. A centrally disposed, generally radial steam inlet 35 applies steam to each of the turbine buckets 20 and stator vanes 30 on opposite axial sides of the turbine 10 to drive the rotor 15. The buckets 20 and the stator vanes 30 form the various stages of the turbine and a flow path therethrough.

The steam turbine 10 also includes an outer exhaust hood 40. The outer exhaust hood 40 surrounds and supports the inner casing 25 as well as other parts such as the bearings and the like. The flow of steam may pass through the stages to an outlet 45 for flow to one or more condensers (not shown) or elsewhere. The exhaust flow path generally is tortuous and subject to pressure losses with a consequent reduction in performance and efficiency. The exhaust hood 40 may include an upper hood 50 and a lower hood 55.

Figure 2:
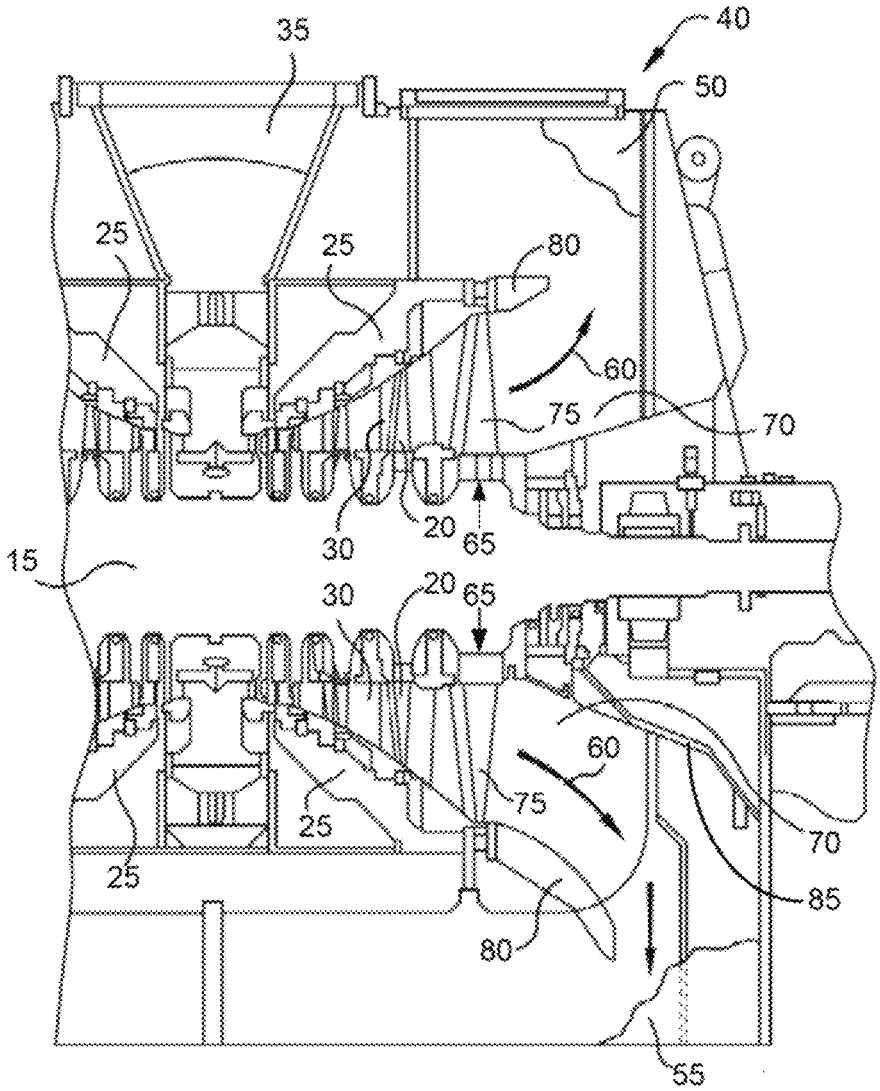
Fig. 2 PRIOR ART
FIG. 2 is a schematic view of a known exhaust hood including an exhaust flow path therethrough.

FIG. 2 shows a schematic view of a known exhaust hood 40 for a gas turbine engine 10 including an exhaust flow path 60 therethrough. As described above, one of the main functions of the exhaust hood 40 is to recover static pressure in the exhaust flow path 60 while guiding the exhaust flow from the rotor buckets 20 to the condenser. A low pressure section 65 of the steam turbine 10 thus includes the steam inlet 35, the turbine stages (rotor buckets 20 and stator vanes 30), and the exhaust hood 50 with a diffuser 70. Part of the exhaust flow path 60 extends down to the condenser through the lower exhaust hood 55 while the remaining flow path extends through the upper exhaust hood 50.

Figure 3:
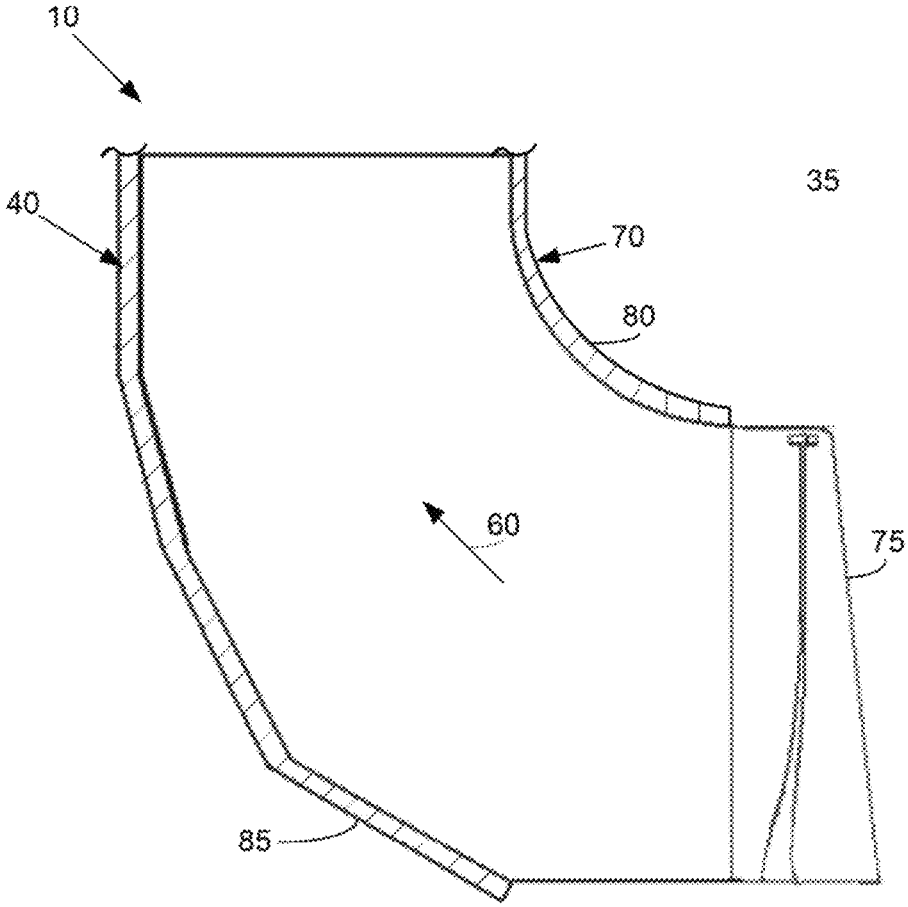
Fig. 3 PRIOR ART
FIG. 3 is a partial cross-sectional view of a known diffuser.

As is shown in FIG. 3, the diffuser 70 may extend from a last bucket 75 and between a steam guide 80 and a portion of a bearing cone 85. As described above, the maximum pressures recovery generally comes at the end of the steam guide 80 because pressure losses generally increase downstream thereof due to improper area scheduling and the like. The available area ratio within the diffuser 70 generally is limited by the configuration of the rotor 15.

Figure 4:
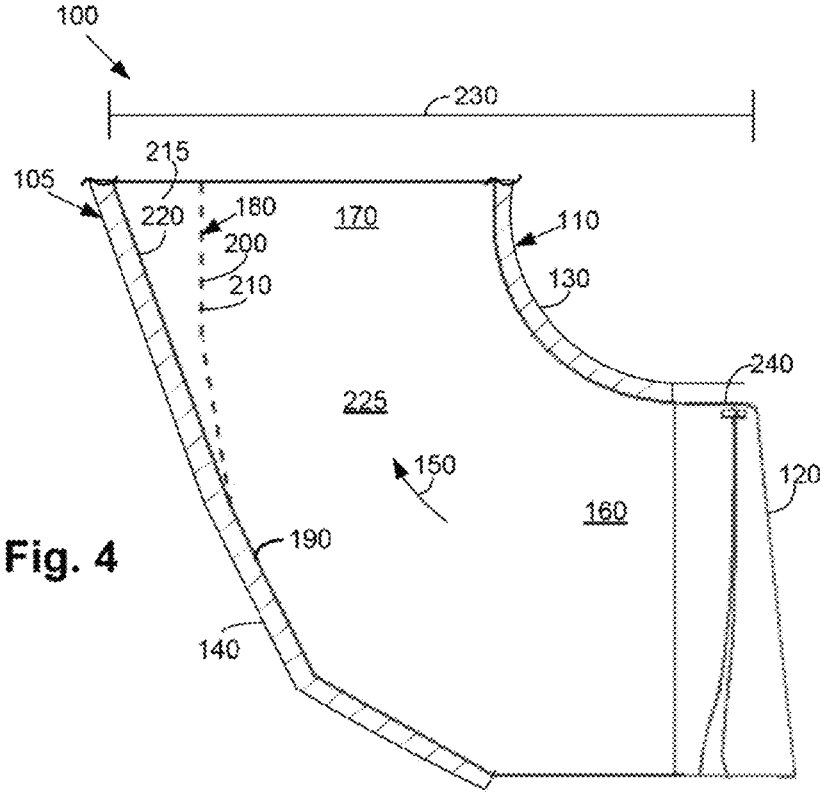
FIG. 4 is a partial cross-sectional view of a diffuser as may be described herein.

FIG. 4 shows a steam turbine 100 with a portion of an exhaust hood 105 having a diffuser 110 as may be described herein. Similar to that described above, the diffuser 110 extends from a last bucket 120 and in-between a steam guide 130 and a portion of a bearing cone 140. The diffuser 110 defines an exhaust flow path 150 therebetween. The diffuser 110 extends from a first end 160 adjacent to the last bucket 120 to a second end 170 downstream of the steam guide 130 and about the bearing cone 140.

As is shown, the second end 170 of the diffuser 110 includes an axial extension 180 within the bearing cone 140. The axial extension 180 extends in length in an axial direction from about a mid portion 190 of the diffuser 110 to the second end 170. A dashed line 200 shows the position of an original outer wall 210 of the original diffuser 70. The axial extension 180 thus defines a roughly triangularly shaped cross-section 215 between the original outer wall 210 and an extended outer wall 220. The axial extension 180 may be defined within the bearing cone 140. The axial extension 180 thus increases an available area ratio 225 at the end of the steam guide 130 so as to increase overall pressure recovery therethrough.

The beginning of the axial extension 180 about the mid portion 190 is by way of example. The axial extension 180 may start at any position that extends the available area ratio 225 and may be below, at, or above the mid portion. The axial extension 180 may be a straight surface, a convex surface, a concave surface or any type of curved surface.

Generally defined, pressure recovery is a function of an axial length 230 of the diffuser 110 from a centerline 240 of the last bucket 120 to an end wall of the diffuser as divided by a length of the last bucket 120. The pressure recovery thus increases by extending the end wall of the diffuser 110 from the original outer wall 210 to the extended outer wall 220. Increased pressure recovery thus provides increased overall performance and efficiency. Moreover, the diffuser 110 herein provides the increased available area ratio 225 while maintaining a relatively short rotor 15 so as to reduce production costs.

Figure 5:
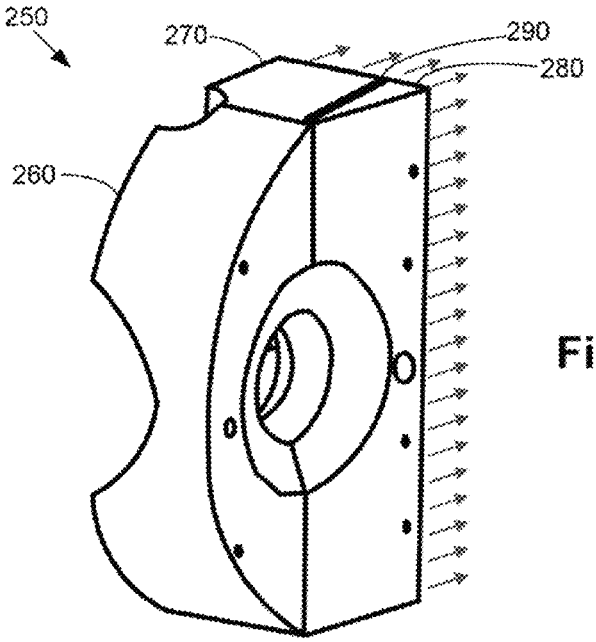
FIG. 5 is a plan view of an alternative embodiment of a side exhaust hood as may be described herein.

FIG. 5 shows a further embodiment of an exhaust hood 250. The exhaust hood 250 may be a side exhaust hood 260. The side exhaust hood 260 also includes a diffuser 270 with an axial extension 280. The extent of the original exhaust hood is shown by line 290. Other angles may be used herein. The axial extension 280 may be implemented by a number of sectors or a full 360 degrees. FIG. 5 shows an extension of about 180 degrees. Other configurations may be used herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A radial diffuser for an exhaust hood of a steam turbine, comprising:

a first end positioned adjacent to a last bucket;

a second end positioned downstream of and radially outward from the first end;

a radially inner flow boundary extending from the first end to the second end and defined by a bearing cone;

a radially outer flow boundary extending from the first end to the second end and defined by a steam guide; and an exhaust flow path extending from the first end to the second end and between the radially inner flow boundary and the radially outer flow boundary;

wherein the radially inner flow boundary comprises a plurality of conical sections, and an axial extension extending directly from one of the conical sections and axially away from the steam guide such that the exhaust flow path expands about the second end.

2. The radial diffuser of claim 1, wherein the axial extension extends from the one of the conical sections at about a mid-portion of the radial diffuser to the second end.

3. The radial diffuser of claim 1, wherein the radially outer flow boundary comprises a curved surface extending from the first end to the second end.

4. The radial diffuser of claim 1, wherein a portion of the exhaust flow path defined by the axial extension comprises a substantially triangular cross-section.

5. The radial diffuser of claim 1, wherein the axial extension increases an available area ratio in the radial diffuser.

6. The radial diffuser of claim 1, wherein the axial extension increases an axial length of the radial diffuser as compared to a rotor of an unchanged length.

7. The radial diffuser of claim 1, wherein the exhaust hood comprises a lower exhaust hood.

8. The radial diffuser of claim 1, wherein the exhaust hood comprises a side exhaust hood.

9. A steam turbine, comprising:

a plurality of buckets positioned about a rotor;

an exhaust hood comprising a radial diffuser, the radial diffuser comprising:

a first end positioned adjacent to a last bucket of the plurality of buckets;

a second end positioned downstream of and radially outward from the first end;

a radially inner flow boundary extending from the first end to the second end and defined by a bearing cone;

a radially outer flow boundary extending from the first end to the second end and defined by a steam guide; and an exhaust flow path extending from the first end to the second end and between the radially inner flow boundary and the radially outer flow boundary;

wherein the radially inner flow boundary comprises a plurality of conical sections, and an axial extension extending directly from one of the conical sections and axially away from the steam guide such that the exhaust flow path expands about the second end.

10. The steam turbine of claim 9, wherein the axial extension extends from the one of the conical sections at about a mid-portion of the radial diffuser to the second end.

11. The steam turbine of claim 9, wherein the radially outer flow boundary comprises a curved surface extending from the first end to the second end.

12. The steam turbine of claim 9, wherein a portion of the exhaust flow path defined by the axial extension comprises a substantially triangular cross-section.

13. The steam turbine of claim 9, wherein the axial extension increases an available area ratio in the radial diffuser.

14. The steam turbine of claim 9, wherein the axial extension increases an axial length of the radial diffuser as compared to a rotor of an unchanged length.

15. The steam turbine of claim 9, wherein the exhaust hood comprises a lower exhaust hood.

16. The steam turbine of claim 9, wherein the exhaust hood comprises a side exhaust hood.

17. An exhaust hood for a steam turbine, comprising:

a steam guide;

a bearing cone; and a radial diffuser comprising:

a first end positioned adjacent to a last bucket;

a second end positioned downstream of and radially outward from the first end;

a radially inner flow boundary extending from the first end to the second end and defined by the bearing cone;

a radially outer flow boundary extending from the first end to the second end and defined by a steam guide; and an exhaust flow path extending from the first end to the second end and between the radially inner flow boundary and the radially outer flow boundary;

wherein the radially inner flow boundary comprises a plurality of conical sections, and an axial extension extending directly from one of the conical sections and axially away from the steam guide such that the exhaust flow path expands about the second end.

18. The exhaust hood of claim 17, wherein the radially outer flow boundary comprises a curved surface extending from the first end to the second end.

19. The exhaust hood of claim 17, wherein the axial extension increases an available area ratio in the radial diffuser.

* * * * *